United States Patent [19]

Lin

[11] 3,978,870

[45] Sept. 7, 1976

[54] COMB WITH DISPOSABLE COMB-TEETH MODULE

[76] Inventor: Chung Sing Lin, No. 182-2 Chung Shan Road, Shan Hua Chen, Tainan Hsien, Taiwan, China

[22] Filed: Aug. 18, 1975

[21] Appl. No.: 605,746

[52] U.S. Cl. ..... 132/11 R; 132/152

[51] Int. Cl.[2] ..... A45D 24/00

[58] Field of Search.....132/11 R, 129, 128, 123, 136, 132/152, 153, 154

[56] References Cited

UNITED STATES PATENTS

| | | | |
|---|---|---|---|
| 1,173,053 | 2/1916 | Sommor | 132/154 |
| 1,305,226 | 5/1919 | Kunkler | 132/152 |
| 1,482,242 | 1/1924 | Michaud | 132/152 |

*Primary Examiner*—G.E. McNeill

[57] ABSTRACT

A novel comb which comprises a comb back, a comb-teeth module detachably mounted on the comb back, and a case member connected to one end of the comb back for serving as a handle. The comb-teeth module comprises a continuous wire wound helically into a plurality of coils in juxtaposition with each coil including a V-shaped lower portion serving as a comb tooth and a rectangular upper portion to define a channel adapted to snugly receive the comb back therein. The comb-teeth module is provided with retainer means at both ends of the wire in order to be fixed on the comb back either in a retracted condition having the comb teeth compacted, or in an extended condition having the comb teeth spaced apart. The novel comb according to the present invention further comprises a plurality of spare comb-teeth modules arranged inside the case member, and a dispenser mechanism for delivering one of the spare modules to a position for use after the soiled module has been discarded.

6 Claims, 9 Drawing Figures

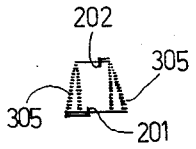
FIG. 2b
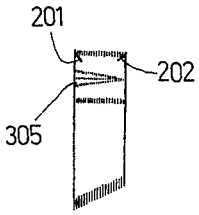
FIG. 2d
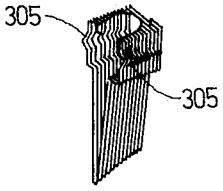
FIG. 2a
FIG. 2c
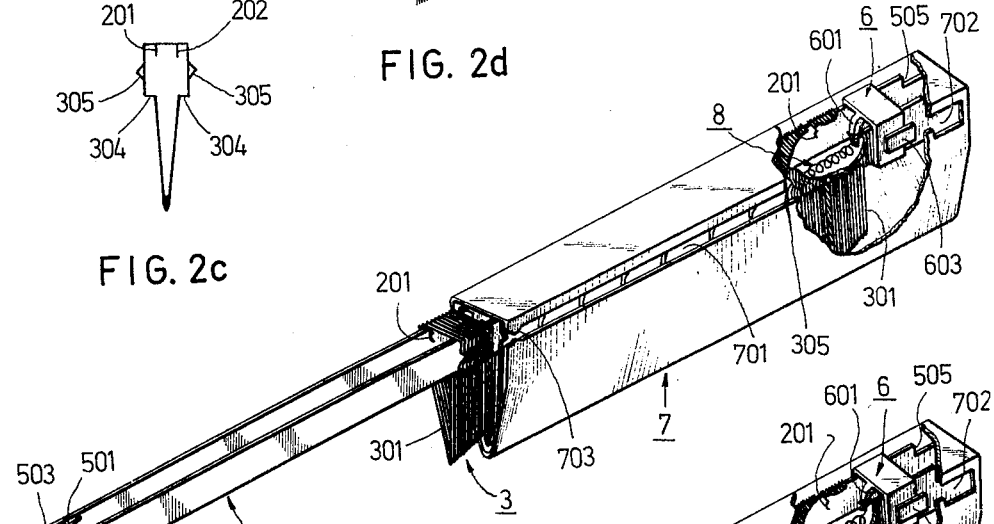
FIG. 4
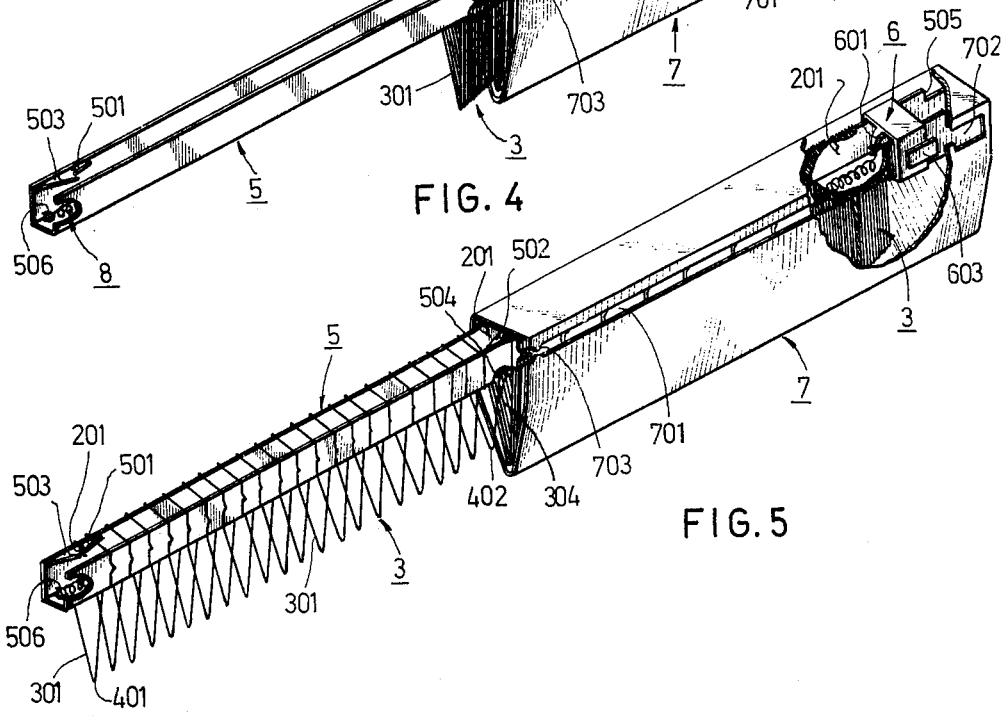
FIG. 5

COMB WITH DISPOSABLE COMB-TEETH MODULE

BACKGROUND OF THE INVENTION

This invention relates to a novel comb, and more particularly to a comb having a detachably mounted comb-teeth module which can be thrown away after use.

A comb heretofore used generally consists of three main portions, namely, a plurality of comb teeth, a comb back for supporting the comb teeth, and a handle connected to the comb back for handling. The comb teeth are generally formed integrally with or permanently secured to the comb back portion. Such a construction has certain disadvantages; for example, the comb teeth are easily soiled, and once they are soiled, difficulty will arise in brushing off the contaminants, especially dandruff and dirt existing in the gaps between the teeth. Furthermore, each tooth generally has a rough surface with sharp edges which cause considerable damage to the hair during combing.

As is well known in the art to which this invention relates, many modifications and improvements have been proposed, such as to provide a sheath for protectively housing the comb, or to provide a device which may be employed both as a comb case and as a cleaner therefor, and so forth. However, so long as the aesthetic appearance and hygienic condition of the comb are taken into account, some of the aforementioned problems still exist.

SUMMARY OF THE INVENTION

It is therefore an object of the present invention to thoroughly eliminate the various disadvantages of the previous comb and to provide a comb of novel type comprising a combteeth module which is detachably mounted on a comb back and which may be replaced with new ones after being soiled.

It is another object of the present invention to provide a noval comb-teeth module comprising a continuous wire wound helically into a plurality of coils coaxially in juxtaposition with each coil including a V-shaped lower portion serving as a comb tooth and an upper portion shaped to define a channel adapted to fit an elongated member therein. The novel comb-teeth module also has retainer means formed at both ends of the wire, by means of which the comb-teeth module may be fixed on an elongated member, either in a retracted condition having comb teeth compacted or in an extended condition having comb teeth spaced apart.

It is a still further object of the present invention to provide a novel comb comprising an elongated comb back, a comb-teeth module detachably mounted on the comb back, a case member connected to one end of the comb back for serving as a handle, a plurality of spare comb-teeth modules snugly and slidably mounted in alignment with each other on the comb back inside the case member, and a dispenser mechanism arranged for causing one of the spare comb-teeth modules to emerge from the inside of the case member after the soiled module has been removed.

Accordingly, the important features of the novel comb according to this invention reside in that the comb may always be kept in hygienic condition by replacing the soiled comb-teeth module with spare ones delivered by the dispenser mechanism thereof, that the comb-teeth module is formed with a single continuous wire having round and smooth surfaces, and that the tip of each tooth is not so sharp as the conventional one.

With these and other objects, features, and advantages in view, the present invention comprises a novel construction, arrangement and formation of parts, as will be hereinafter more specifically described, by way of example, with reference to the accompanying drawings.

BRIEF DESCRIPTION OF THE DRAWING

FIGS. 2*a* to 2*d* are perspective view and side views of a comb-teeth module according to the present invention in a normally retracted condition having particularly shaped coils closely compacted.

FIG. 4 shows the novel comb of FIG. 3, partly cut away, illustrating a plurality of comb-teeth modules are contained in a dispenser mechanism and one of the comb-teeth modules is retracted to a position adjacent to the handle.

FIG. 5 shows the novel comb of FIG. 4, partly cut away, illustrating that one of the comb-teeth modules is fixed in an extended condition having comb teeth spaced along the comb back for use.

DETAILED DESCRIPTION OF THE PREFERRED EMBODIMENT

Figure 1:
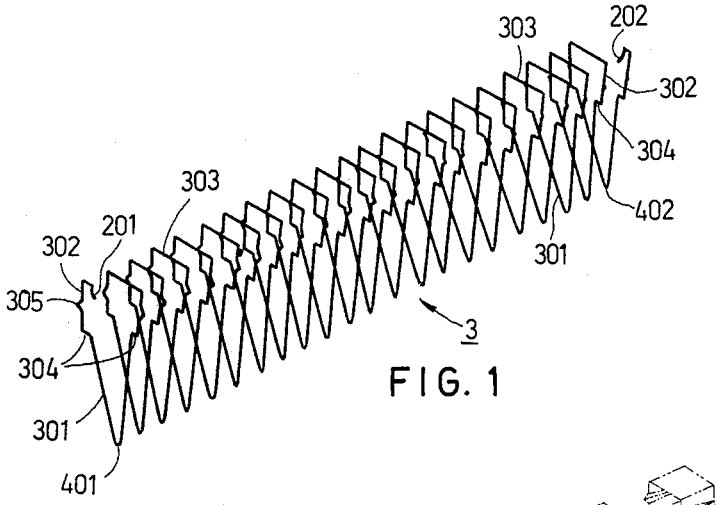
FIG. 1 is a perspective view of a comb-teeth module according to the present invention in an extended condition having particularly shaped coils spaced apart to serve as comb teeth.

Reference is now made to the drawings for a better understanding of this invention, wherein similar reference characters designate corresponding parts throughout the several views. As is evident in FIG. 1, a novel comb-teeth module in extended condition, generally designated by numeral 3, comprises a single continuous wire wound helically into a series of coils aligned in juxtaposition with each coil including a V-shaped portion 301 presenting a tip 401 and a substantially rectangular portion composed of segments 302, 303 and 304. Actually, these coils are formed with a normally compacted space relationship as shown in FIG. 2*a*, so that all of the rectangular portions accumulate to define a channel for inserting an elongated member therein. A segment of suitable length at each end of the wire is deflected into the plane defined by the coil in order to function as a retainer means, designated by numerals 201 and 202, of which the purpose will be more apparent hereinafter, and substantially the retainer means 201 and 202 are positioned diagonally of the rectangular portion as best seen in FIG. 2*d*.

For operating convenience, in the middle of each segment 302 of all coils, the wire is formed with an outward projecting protuberance 305 which decreases in size coil by coil, as shown in FIG. 2*a*. It should be noted, a hard steel wire having a diameter of about 0.32 mm (i.e. between 0.29 mm and 0.35 mm) and a tensile strength greater than 260 kg/mm$^2$ is preferably selected for a comb-teeth module described heretofore, and typically, with the length of the segments 301 uniformly decreasing in length coil by coil from 16 mm to 12 mm, a good combing effect may be obtained as the combteeth module is fixed in an extended condition to keep the coils apart from each other with a uniform distance of 3 mm.

Figure 3:
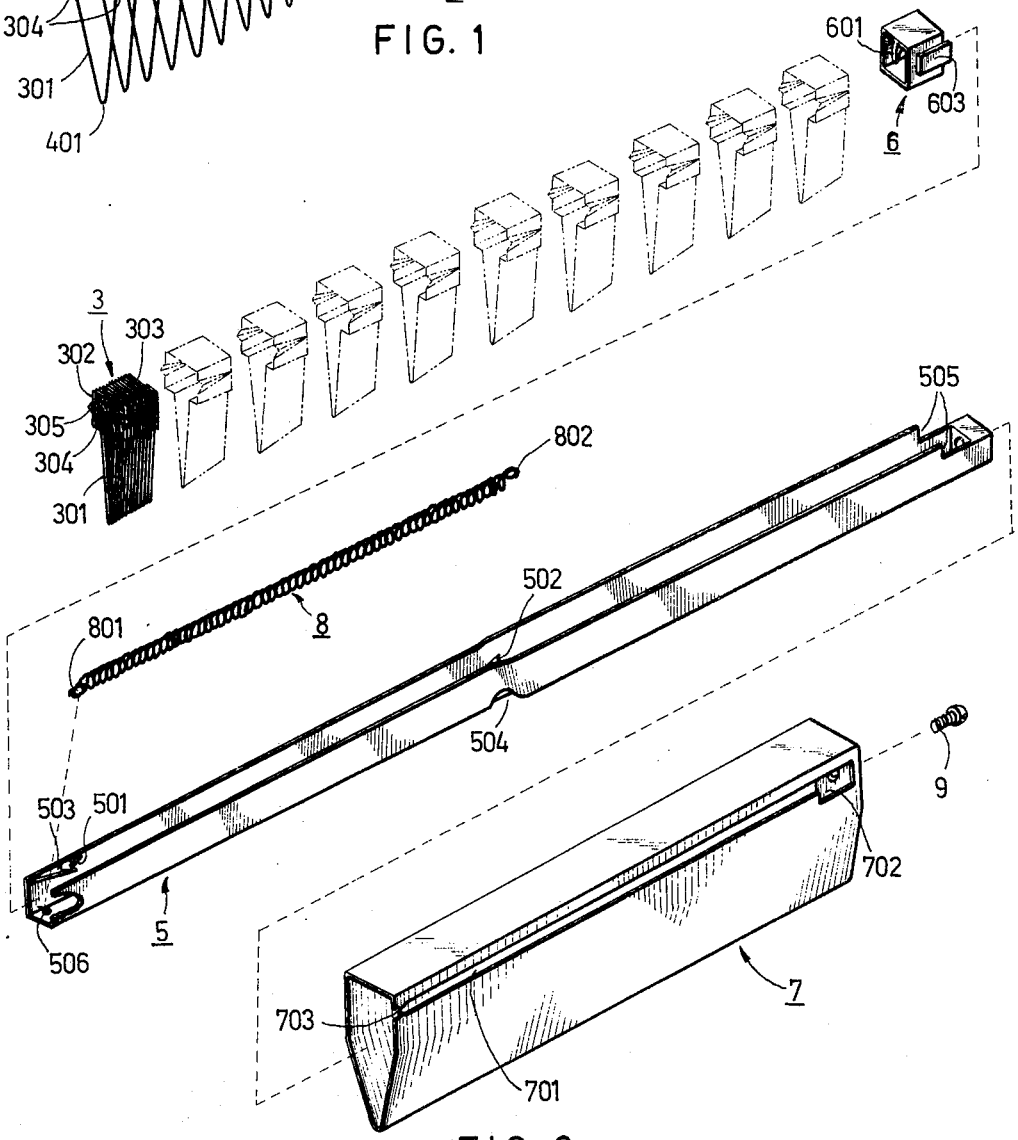
FIG. 3 is an exploded perspective view of a novel comb according to the present invention.

Turning now to FIG. 3, a preferred embodiment of the novel comb according to this invention is shown in an exploded view. As can be seen, the novel comb comprises a plurality of comb-teeth modules 3, a grooved comb back member 5, a case member 7, a screw 9 for connecting the case member 7 to the comb back member 5, and a dispenser mechanism including a coil spring 8 and a pusher member 6.

The comb back member 5 has a U-shaped groove extending therethrough for receiving the coil spring 8, of which one end 801 is mounted on a hook member 506 provided on one end of the bottom of the groove, and the other end 802 is mounted on a hook member 601 provided on the pusher member 6 located in a recess 505 at the other end of the comb back so that the spring 8 is always in tension and applies a pulling force to the pusher member 6.

A plurality of comb-teeth modules 3 are slidably mounted in alignment with each other on the comb back portion adjacent to the pusher member 6, with the comb base portion snugly extending through the channel defined by the rectangular portions of the comb-teeth modules. The case member 7, having an opening at one end, is provided to envelop the comb-teeth modules 3 as well as the comb back portion and is connected to the comb back 5 with a screw 9, such that the case member 7 covers approximately one half of the comb back and serves as a handle as shown in FIG. 4.

Figure 6:
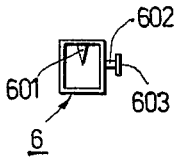
FIG. 6 is an elevational view of a pusher member in the dispenser mechanism of the novel comb according to the present invention.

The pusher member 6, as clearly shown in FIG. 6, is substantially a slide of rectangular form adapted to be fitted onto the comb back and snugly slidable thereon, and comprises a knob 603 connected through a rod 602, and a hook 601 for retaining the coil spring 8. In the assembly shown in FIG. 4, the pusher member 6 is originally located in the recess 505 with the knob 603 exposed to the outside of the case member 7 and the rod 602 received in an opening 702, which is formed on the case member 7 in registration with the recess 505. After being caused to be out of the recess 505, the pusher member 6 will be movable under the tension of the coil spring 8 with the rod 602 sliding along a slit 701, which extends longitudinally along the case member 7 with one end communicating with the opening 702 while the other end is closed by a pair of tabs 703. So long as the pusher member 6 is positioned outside the recess 505, all of the comb-teeth modules are subjected to the tension of the coil spring 8, and as a result, one of the modules is slid to the outside of the case member 7 and stopped by a hook 502, which is provided on the inner wall of the U-shaped groove and is adapted to catch the retainer means 202 at the coil end and engage therewith, as shown in FIG. 4. Furthermore, as recess 504, as best seen in FIG. 3 is formed on the edge of the comb back under the hook 502 for facility of operation, and at the end remote from the case member 7, a hook 501 with a protective tab 503 is attached to the inner wall of the U-shaped groove in order to hold the retainer means 201 and keep the comb-teeth module in its extended condition.

The operation of the novel comb is believed to be clearly apparent and is briefly summarized at this point.

To employ the novel comb, the comb-teeth module, with the retainer means 202 caught by the hook 502, is slightly nipped at the protuberance 305 and is thrust toward the end of the comb back until the retainer means 201 thereof is caught by the hook 501. With the retainer means 201 and 202 positioned as described, the comb teeth are kept apart for use, as shown in FIG. 5.

When not in use, the retainer means 201 is released from restraint of the hook 501 and the comb teeth are drawn into the retracted position by the restoring force existing in a coil-winding structure, as shown in FIG. 4. In such retracted and compacted position, the teeth are prevented from damage and soiling. Once the comb teeth are soiled or worn out such as to be thrown away, by pushing the segment 304 of the coil including the retainer means 202 upward into the recess 504 to cause the retainer means 202 to move out of the restraint of the hook 502, the comb-teeth module is removed from the comb back and a new module is automatically delivered from the inside of the case member 7 with its retainer means 202 caught by the hook 502.

Although the invention has been herein shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus.

What is claimed is:

1. A novel comb comprising:

a comb back;

a comb-teeth module detachably mounted on the comb back; and a case member connected to one end of the comb back for serving as a handle;

charactered in that the comb-teeth module comprises:

a continuous wire wound helically into a plurality of coils in juxtaposition with each coil including a V-shaped lower portion serving as a comb tooth element and a rectangular upper portion defining a channel adapted to snugly receive the comb back therein, said wire including retainer means at both ends of the wire for engaging the comb back whereby the comb teeth module can be retained on the comb back either in a retracted condition having comb teeth compacted or in an extended condition having comb teeth spaced apart.

2. A novel comb as defined in claim 1, further comprising:

a plurality of spare comb-teeth modules arranged inside the case member; and a dispenser mechanism for delivering one of the spare modules to a position for use after a readily soiled module is discarded.

3. A novel comb as defined in claim 2, wherein the dispenser mechanism includes:

a pusher member slidably mounted on the comb back portion inside the case member; and a coil spring, said pusher member being normally under the tension force of said coil spring for causing one of the spare modules to move from the inside of the case member to a position for use after a soiled module is discarded.

4. A disposable comb-teeth module comprising:

a continuous wire wound helically into a plurality of coils in juxtaposition with each coil including a V-shaped lower portion serving as a comb tooth, and formed with a rectangular upper portion defining a channel adapted to snugly receive an elongated member therein, said wire including retainer means provided at both ends of the wire.

5. A comb-teeth module as defined in claim 1, wherein said continuous wire is of hard steel wire having a diameter in the range from 0.29 mm to 0.35 mm and a tensile strength greater than 260 kg/mm$^2$.

6. A comb-teeth module as defined in claim 4, wherein said continuous wire is of hard steel wire having a diameter in the range from 0.29 mm to 0.35 mm and a tensile strength greater than 260 kg/mm$^2$.

* * * * *